United States Patent [19]

Bolin

[11] Patent Number: 4,593,404

[45] Date of Patent: Jun. 3, 1986

[54] METHOD OF IMPROVING THE ACOUSTICS OF A HALL

[76] Inventor: Gustav G. A. Bolin, Renstierras Gata 12, Stockholm, Sweden

[21] Appl. No.: 632,252

[22] Filed: Jul. 17, 1984

Related U.S. Application Data

[63] Continuation of Ser. No. 456,126, Jan. 6, 1983, abandoned, which is a continuation of Ser. No. 196,706, Oct. 14, 1980, abandoned.

[30] Foreign Application Priority Data

Oct. 16, 1979 [SE] Sweden ..... 7908568

[51] Int. Cl.[4] ..... H04R 27/00

[52] U.S. Cl. ..... 381/82; 381/88

[58] Field of Search ..... 381/77, 82, 83, 118, 381/120, 89, 90; 179/181 W

[56] References Cited

U.S. PATENT DOCUMENTS

| | | | |
|---|---|---|---|
| 1,746,289 | 2/1930 | Simpson . | |
| 1,962,055 | 6/1934 | Cawley | 179/181 W |
| 2,208,068 | 7/1940 | Blaski | 179/1 AT |
| 3,535,453 | 10/1970 | Veneklasen | 179/1 AT |
| 3,609,253 | 9/1971 | Ashworth | 179/181 W |
| 3,668,295 | 6/1972 | Broussard | 84/1.15 |
| 3,908,503 | 9/1975 | Bolin | 84/1.14 X |
| 3,999,014 | 12/1976 | Bascom | 179/1 AT |
| 4,050,341 | 9/1977 | Underwood | 84/1.15 |
| 4,061,876 | 12/1977 | Jaffe | 179/1 AT |
| 4,104,945 | 8/1978 | Bolin | 84/1.15 |
| 4,290,332 | 9/1981 | Schoeffling, Jr. | 84/1.14 |
| 4,330,691 | 5/1982 | Gordon | 179/1 AT |

FOREIGN PATENT DOCUMENTS

| | | | |
|---|---|---|---|
| 1903661 | 9/1969 | Fed. Rep. of Germany | 179/1 AT |
| 919305 | 2/1963 | United Kingdom | 179/1 AT |
| 1447588 | 8/1976 | United Kingdom | 179/181 W |

*Primary Examiner*—Forester W. Isen

*Attorney, Agent, or Firm*—Dowell & Dowell

[57] ABSTRACT

The invention relates to a method to improve the acoustics of a room, preferably a hall, having a relatively minor space (10) from which sound waves, chiefly emanating from a musical instrument, and a relatively larger audience space (12), the outgoing sound waves being re-emitted via an amplifier device comprising a sounding board (20, 22) united with an electromagnet (26), an amplifier (21) and a microphone connected therewith, which device receives impulses from the sound source (14). The sound board (20, 22) and the electromagnet (26) form part of each of a plurality of wall elements (16) of such area and location in the audience space (12) that the sounding boards transmit to the listener a mixture of sound waves directly reflected from the sound source (14) and sound waves indirectly emanating from the amplifier device.

5 Claims, 5 Drawing Figures

METHOD OF IMPROVING THE ACOUSTICS OF A HALL

Figure 1:
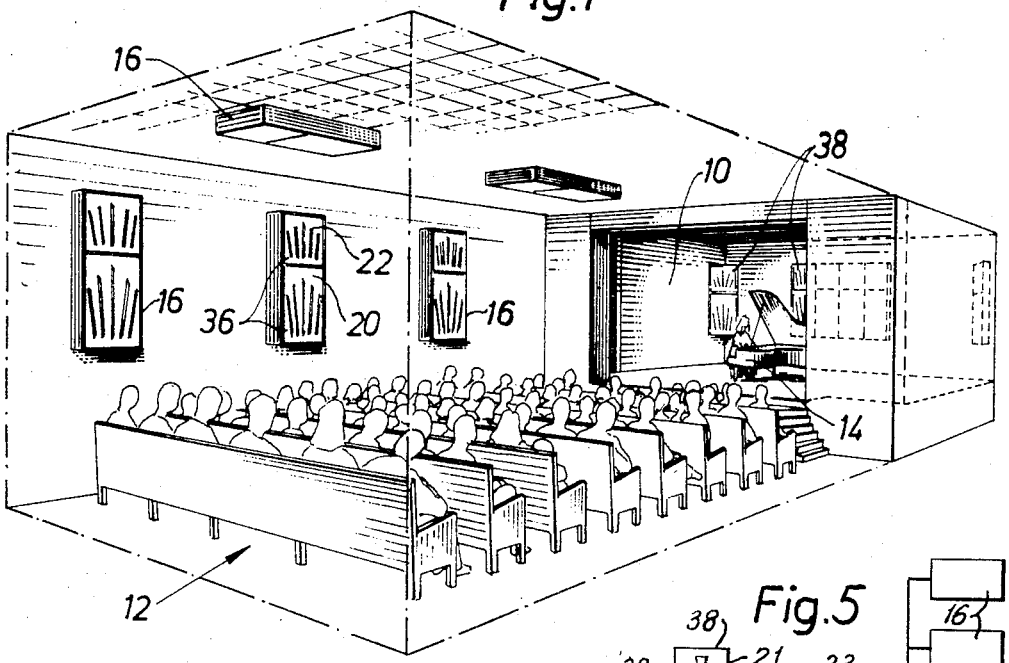

This application is a continuation of application Ser. No. 456,126, filed 1/6/83, now abandoned, which is a continuation of Ser. No. 196,706 filed 10/14/80, now abandoned.

The present invention relates to a method to improve the acoustics of a room, preferably a hall, having a relatively minor space from which sound waves, generally created by a musical instrument, are emitted, and a relatively larger audience space such as a concert hall. The sound waves reaching a listener in the audience space pass through the air space both directly from the sound source and partly via the bounding surfaces of the room (ceiling, walls etc.) which surfaces serve as reflectors for the sound waves and impart to the room its distinctive acoustic character. As is well known, the acoustic properties are highly varying with different rooms and halls both as far as voice and music are concerned. A substantial factor in this connection is, in addition to the shape of the room, the nature of the surfaces which absorb and reflect the sound waves. As an example, a room having soft walls generally is unsuitable in connection with a musical performance even when it is suited for oration. Such a wall is defined as dry in connection with the reproduction of music. Furthermore, the sound volume decreases with increased spacing from the sound source, and to remedy this inconvenience loudspeakers are used which amplify and from a place much restricted to its area reproduce the sound waves in a manner which takes away a substantial portion of the tonal quality inherent to the musical instrument.

It is known from applicants U.S. Pat. Nos. 3,908,503 and 4,104,945, respectively to re-emit the sound waves emitted from a musical instrument via an amplifier device which contains a sound board united with an electromagnet which together constitute a soundboard, a sound amplifier and a microphone of the crystal type, which microphone is connected with the musical instrument, e.g. the guitar or other stringed instrument. Such soundboards reproduce the initially produced music in an extremely favourable manner, but they cannot influence the acoustics of the room itself.

It is the purpose of the present invention to provide a method of improving the acoustics of a room even in such cases where the room has been deemed acoustically unsuitable unless substantial alterations are made in the room or the walls thereof are replaced. The term walls may, in this connection, also include ceilings. The invention is substantially characterized in that sounding boards having electromagnets associated therewith are used to form a plurality of wall elements of such area and are so positioned in the audience space of hall that the sounding boards transmit to the listener a mixture of sound waves directly reflected from the sound source and sound waves emanating indirectly from an amplifier device.

The invention shall be described in greater detail herebelow with reference to an embodiment specified by way of example in the attached drawing. Other features characterizing the invention will be indicated in this connection also.

In FIG. 1, there is shown in a perspective view an assembly hall which is equipped with wall elements according to the invention.

Figure 2:
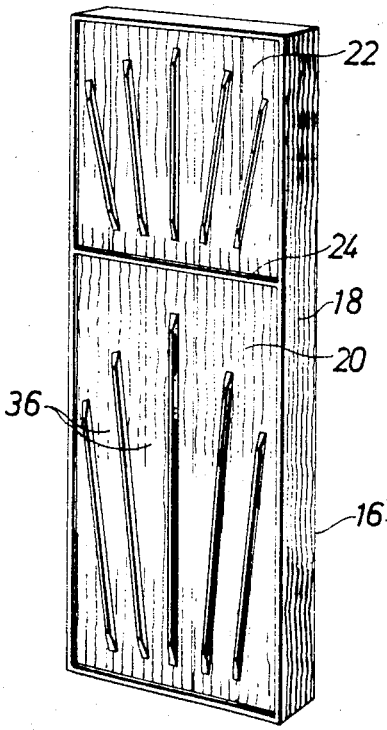
Figure 3:
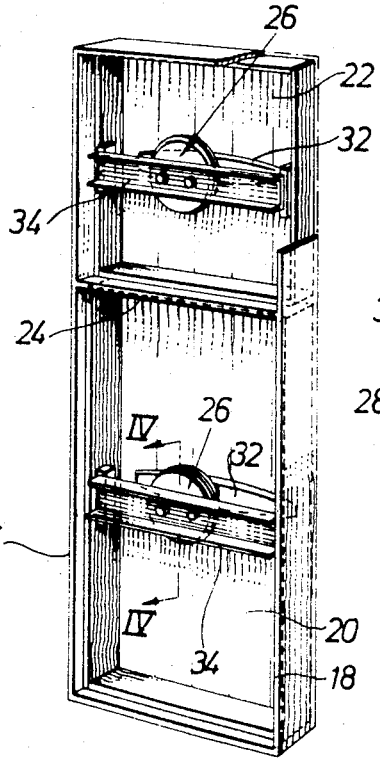

In FIGS. 2 and 3, there is shown such an element viewed from, respectively, the front and the rear side.

Figure 4:
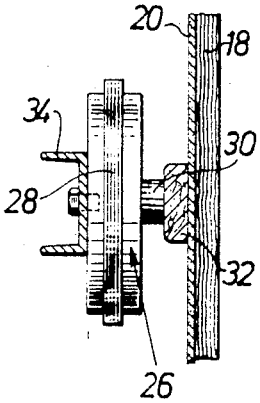

In FIG. 4, there is shown a section of an element on a greater scale along the line IV—IV in FIG. 3.

Figure 5:
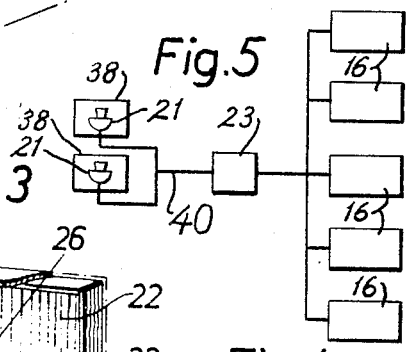

FIG. 5 is a schematic illustration of the electrical connection between components of the invention.

The assembly hall shown in FIG. 1 has a minor space or stage 10 and a larger audience space 12. As illustrated it is assumed that a concert is being given in the hall, music being emitted from a piano instrument 14. Disposed in the audience space 12 are a plurality of sound-active elements 16 which are suspended on the walls and suitably also attached to the ceiling. Each such sounding element has the shape of a box which may be open towards the wall and which consists of a square frame 18 which on its side facing the hall carries a sounding board consisting of a sheet of wood. The elements may have an elongated contour and be provided with two sounding boards 20, 22 separated from one another by a transverse frame piece 24 and which are suitably of different magnitude. Inside the sounding boards there is provided an electromagnet 26 composed of a coil 28 and an armature 30 which armature bears against a transverse, relatively strong strip or bridge 32 which is secured onto the sounding board. The coil 28 of the electromagnet is connected to a transverse girder 34 which is secured to the lateral frame 18. A plurality of strips 35 are secured by glueing to the side of the sounding boards 20, 22 facing the space the strips are constructed of wood with the central one mounted parallel to the longitudinal axis of the element, whereas the shorter strips located on either side thereof diverge slightly outwardly relative to the axis. The wood fibres in the sounding boards have the same main direction as the strips 36. The boards 20 and 22, respectively, may have a thickness of up to 10 mms.

Placed on the stage or proscenium 10 are one or more wall elements 38 which principally may be of the same design as those just described, but which in contrast thereto are without electromagnets, but instead have one or more pressure-sensitive microphones 21 of the crystal type disclosed in the above-cited patents and which are secured onto the sounding boards of these wall elements. These sounding boards have a minor thickness such as some few mms as compared with the sounding boards of the wall element 16. From the microphones electric wires or cables 40 go to wall elements 16 in the audience space and are there connected to the same by coils 28 of the electromagnets. These wires are additionally connected to a sound amplifier 23 so that the output thereof is connected to the coils of the electromagnets as shown diagrammatically in FIG. 5. The microphones, wires and amplifiers are not shown in the drawing, but are disclosed as to their function and manner of operation by the above-mentioned patents.

The sounds which the piano-player produces by means of the instrument 14 are transmitted in usual manner to the listeners via the air space in the hall. The sound waves are also taken up by the sounding boards of the wall elements 38 behind or adjacent the instrument as vibrations which by the microphones and wires are transmitted to the wall elements in the listener's space. There an amplified reproduction of the sound waves is effected via the sounding boards 20 and 22 of the elements 16 to the listeners. Simultaneously, a direct transmission of the primary sound waves of the instrument is effected to the wall elements 16 in the audience space and the sound boards of these elements in turn reproduce these sound waves also in amplified form. The music will thus be received by the ears of the listeners as a harmonically amplified mixture as it is re-emitted from the wall elements 16 partly directly through the air space and partly indirectly via the wall elements 38 located adjacent the sound source.

In this connection one is able to compensate using known means for the time staggering of sound which is caused by the much higher velocity of the electric impulses over the velocity of sound in the air. Apparatuses of this kind are known and thus do not form part of the present invention. It is essential that the original sound waves are re-emitted from the wall elements which even if they constitute a little portion only of the total wall area nevertheless produce a double resonance of the music in a manner which acoustically dominates over the wall surfaces and at the same time retains the beauty of the tonal quality which is characteristic of the primary instrument.

When adapting a room or hall having bad acoustic the number of sound elements and the placing thereof in relation to one another are made out empirically from case to case by syntonization of the acoustics. Each wall element has a relatively large surface defined by its sounding boards facing the room and may thus have a height of 1½ meters and more. The surface of each element may amount to at least 1 to 2 square meters. Due to the amplification and beautifully shaped reproduction of the sound waves which the elements bring about, they need occupy only a minor part of the total wall area and will thereby eliminate totally the effect of the bad acoustic properties of the walls.

Due to the fact that the sound producing instruments are not directly coupled to the resonators or sound elements but deliver impulses to resonators or sound elements located adjacent the sound source via the air space, the method according to the invention can be applied also to orchestras with many different instruments or to such instruments which contrary to stringed instruments lack there own sounding part which by the sound waves is cause to vibrate.

It is conceivable, however, that a microphone may be mounted directly to an instrument, such as a stringed instrument, with such microphone being directly connected by way of electric wires to the wall elements 16.

I claim:

1. A method of improving the acoustics of a room having a performance area in which sound is generated from a sound source and an audience listening area which is spaced from the performance area and which is defined by wall and ceiling elements, utilizing first soundboard means, the first soundboard being of a box shape configuration having a substantially planar wooden outer surface element which is mounted to a frame, the soundboard being open on the side opposite the wooden outer surface, the wooden surface element being no greater than 10 mms. in thickness so that the wooden outer surfaces element will vibrate in response to sound waves traveling through the air thereby the first soundboard will reflect sound waves traveling through the air toward the first soundboard means, and electromagnetic means mounted within the first soundboard means so as to vibrate the outer surface element thereof so that the first soundboard means generates sound waves induced by the electromagnetic means connected thereto comprising the steps of:

(a) mounting at least one of the first soundboard means to at least one of the wall or ceiling elements so as to overlay a portion of the wall or ceiling elements within the audience listening area and remote from the sound source so that the outer surface element is oriented toward the audience listening area and away from the one wall or ceiling element;

(b) positioning microphone means within the performance area to receive sound waves eminating from the sound source;

(c) electrically connecting said microphone means to the electromagnetic means of the first soundboard means so that the electromagnetic means of the first soundboard means receives electrical impulses transmitted from said microphone means; and (d) amplifying the electric impulses transmitted from the microphone means to the electromagnetic means of the first soundboard means so that the first soundboard means is acted upon by vibrations generated by the electromagnetic means from electrical impulses received from said microphone means from the sound source while simultaneously being vibrated by sound waves received directly through the air from the sound source whereby the sound waves emitted from the first soundboard means is a combination of reflected and electrically generated sound waves.

2. The method of claim 1 including mounting at least one second soundboard means within the performance area so as to overlay a wall or ceiling element thereof, said second soundboard means having a box shape configuration with a substantially planar wooden outer surface element which is mounted to a frame, the second soundboard being open on the opposite side of the wooden outer surface element, the wooden surface element being of lesser thickness than the wooden surface element of the first soundboard means, and mounting said microphone means within said second soundboard means so as to receive vibrations which are created by the outer surface element of said second soundboard means in response to sound waves impacting there against from the sound source.

3. The method of claim 2 in which a plurality of said first soundboard means are mounted to both the wall and ceiling elements of the audience listening area.

4. An apparatus for improving the acoustics of a room having a performance area in which sound waves are generated from a sound source toward an audience listening area defined by walls and ceiling and which is spaced from the performance area comprising, at least one first soundboard means disposed within the audience listening area remote from the sound source, said first soundboard means being directly mountable to a wall or ceiling of the listening area and having a box shape configuration having a peripheral frame and a substantially planar wooden outer surface element mounted on one side of said frame, said first soundboard means being open on the side opposite the outer wooden surface element, said outer wooden surface element being no greater than approximately 10 mms. in thickness and being mounted to said frame so as to reflect sound waves received directly through the air exteriorly of said first soundboard means, an electromagnetic means carried within said first soundboard means so as to be between said outer wooden surface element and a wall or ceiling of the audience listening space and connected to vibrate said outer wooden surface element thereof, a microphone means disposed adjacent to the sound source, electrical means connecting said microphone means to said electromagnetic means within said first soundboard means, whereby said first soundboard means emits sounds which are a combination of the sound waves received through the air directly from the sound source and reflected thereby and of the sound waves generated by said electromagnetic means from electric impulses received from said microphone means.

5. The apparatus of claim 4 in which the outer wooden surface element includes first and second sections having different areas, the wood defining the outer surface of said first and second sections having a grain extending generally uniformly with respect to one another, and an electromagnetic means connected to each of said first and second sections.

* * * * *